US007999743B2

(12) United States Patent
Huber et al.

(10) Patent No.: US 7,999,743 B2
(45) Date of Patent: Aug. 16, 2011

(54) MULTIBAND ANTENNA ARRAY FOR MOBILE RADIO EQUIPMENT

(75) Inventors: Stefan Huber, München (DE); Thorsten Kowalski, München (DE); Michael Schreiber, Aying-Göggenhofen (DE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/543,008

(22) PCT Filed: Aug. 8, 2003

(86) PCT No.: PCT/DE03/02672

§ 371 (c)(1),
(2), (4) Date: Jul. 21, 2005

(87) PCT Pub. No.: WO2004/070875

PCT Pub. Date: Aug. 19, 2004

(65) Prior Publication Data

US 2006/0055602 A1 Mar. 16, 2006

(30) Foreign Application Priority Data

Jan. 24, 2003 (DE) ..... 103 02 805

(51) Int. Cl.
*H01Q 19/00* (2006.01)

(52) U.S. Cl. ..... 343/700 MS; 343/833

(58) Field of Classification Search ..... 343/700 MS, 343/702, 833, 834, 837, 893
See application file for complete search history.

(56) References Cited

U.S. PATENT DOCUMENTS

| | | | | |
|---|---|---|---|---|
| 5,966,097 | A | 10/1999 | Fukasawa et al. | |
| 6,323,810 | B1 * | 11/2001 | Poilasne et al. | 343/700 MS |
| 6,456,249 | B1 * | 9/2002 | Johnson et al. | 343/702 |
| 6,657,593 | B2 * | 12/2003 | Nagumo et al. | 343/700 MS |
| 6,680,705 | B2 * | 1/2004 | Tan et al. | 343/702 |
| 6,788,257 | B2 * | 9/2004 | Fang et al. | 343/700 MS |
| 6,958,730 | B2 * | 10/2005 | Nagumo et al. | 343/702 |
| 7,046,196 | B1 * | 5/2006 | Langley et al. | 343/700 MS |
| 2001/0050636 | A1 * | 12/2001 | Weinberger | 343/700 MS |
| 2001/0050643 | A1 | 12/2001 | Egorow et al. | |
| 2002/0019247 | A1 | 2/2002 | Egorow | |
| 2002/0163470 | A1 | 11/2002 | Nagumo et al. | |
| 2003/0210188 | A1 * | 11/2003 | Hebron et al. | 343/700 MS |

FOREIGN PATENT DOCUMENTS

| | | |
|---|---|---|
| DE | 102 19 654 | 12/2002 |
| EP | 0 831 547 | 3/1998 |
| EP | 1 024 552 | 8/2000 |
| EP | 1 026 774 | 8/2000 |
| EP | 1 067 627 | 1/2001 |
| WO | WO 00/52784 | 9/2000 |
| WO | WO 00/57511 | 9/2000 |
| WO | WO 01/33665 | 5/2001 |
| WO | WO 02/078124 | 10/2002 |

* cited by examiner

*Primary Examiner* — Jacob Y Choi
*Assistant Examiner* — Robert Karacsony

(57) ABSTRACT

A multiband antenna array for mobile radio equipment that includes a planar pitch antenna having at least two resonances and is provided with a connection to ground and a high-frequency interface and at least two parasitic transmitters which are located marginal to the planar patch antenna and are embodied so as to be free of a high-frequency interface. A particularly compact multiband antenna for several frequency bands is crated as a result of the special arrangement of the planar patch antenna and the parasitic transmitters.

10 Claims, 4 Drawing Sheets

MULTIBAND ANTENNA ARRAY FOR MOBILE RADIO EQUIPMENT

The present disclosure relates to multiband antenna array for mobile radio equipment that include a planar patch antenna having at least two resonances and is provided with a connection to ground and a high-frequency interface and at least two parasitic transmitters which are located marginal to the planar patch antenna and are each embodied so as to be free of a high-frequency interface.

BACKGROUND

As a result of the continuous developments in the area of mobile radio technology, such as for example the expansion of the GSM network (GSM=Global System for Mobile Communication) through the UMTS network (UMTS=Universal Mobile Telecommunications System), antennas designed to cover several frequency bands are needed. At the same time, because of the sophisticated requirements of many customers, mobile radio equipment must firstly be designed so as to be smaller and more compact in terms of its dimensions and secondly be manufactured more inexpensively.

For this reason, the antennas for mobile radio equipment also have to be optimized in terms of frequency coverage, manufacturing costs and the structural space needed for the antenna.

In order to be able to cover multiple frequency bands with the multiband antenna, a number of solutions are already known. In one variant of the solution, multiple planar patch antennas are integrated in a mobile radio device. A disadvantage of integrating multiple antennas into one multiband antenna is that multiple feed points are required for the planar patch antennas, and consequently the construction of the multiband antenna is complicated.

In the applicant's European patent EP 1 024 552 A2, a multiband antenna is presented which was already an improvement in terms of the production costs and spatial requirements. This improvement was achieved by virtue of the fact that the multiband antenna consists of a combination of multiple different types of antenna which are all fed at just one point. By this means, both the manufacturing costs and the spatial requirements of the antenna can be reduced.

For the latest generation of mobile radio equipment, however, this multiband antenna is still not satisfactory in terms of its spatial requirements and manufacturing costs.

Accordingly, a multiband antenna array for mobile radio equipment is needed that also enables a further reduction in manufacturing costs while simultaneously reducing the antenna space needed.

SUMMARY

Under an exemplary embodiment, a multiband antenna array for mobile radio equipment includes a planar patch antenna that has at least two resonances and is provided with a connection to ground and a high-frequency interface and at least two parasitic transmitters which are located marginal to the planar patch antenna and are each embodied so as to be free of a high-frequency interface.

The parasitic transmitters are preferably arranged closely adjacent to the planar patch antenna. Under this arrangement, the overall structural space for the multiband antenna array can be designed so as to be extremely compact. Parasitic transmitters are deemed to be types of antenna that do not have a high-frequency interface. The two parasitic transmitters can for example be designed for the GSM850 band and for the GSM1900 band.

The planar patch antenna can be fashioned both as a planar inverted F-antenna (PIFA antenna) and as a planar inverted L-antenna. This planar patch antenna can, for example, have resonances in the GSM900 band and in the GSM1800 band.

The arrangement of the planar patch antenna and of the marginally located parasitic transmitters mentioned above opens up a plurality of different production methods for such a multiband antenna array.

The antenna can be manufactured from Fr4 material. The disadvantage here is that for this the antenna has to be planar, that is can be extended in two dimensions only.

A further production method for this multiband antenna array is stamping and forming technology. In this case, it is possible to shape the multiband antenna three-dimensionally. By this means, the multiband antenna array can be adapted for example to the shape of the mobile radio equipment housing.

The multiband antenna array can, however, also be produced using the MID method (MID=molded interconnect devices). With this, as with stamping and forming technology, three-dimensional forms of multiband antenna can be produced. However, compared with stamping and forming technology, the MID method enables the production of finer-precision antenna structures.

The multiband antenna array also enables the realization of different types of coupling between the planar patch antenna and the parasitic transmitters. The type and strength of the coupling makes it possible either to enlarge the bandwidth of a resonance generated by the antenna patch or to integrate an additional resonance. In this case, through radiative coupling and/or galvanic coupling with the shared ground of the antenna system, the parasitic transmitters can be excited by the patch structure.

It is favorable if at least one parasitic transmitter is provided with a connection to ground. This gives rise to a galvanic coupling of this parasitic transmitter to the planar patch antenna. The second parasitic transmitter can then be connected, for example, by means of radiative coupling to the planar patch antenna, i.e. the coupling between the planar patch antenna and the second parasitic transmitter takes place through radiation excitation for example over the airway.

The planar patch antenna and the parasitic transmitters can also be arranged in a plane. By this means, the multiband antenna can be incorporated particularly flatly in the housing of the mobile radio device, as a result of which the mobile radio device, for example a mobile phone, can be designed so as to be slimmer and thus more compact overall.

Sometimes, however, it is also advantageous for at least one parasitic transmitter to have a spatial extension, emerging preferably perpendicularly out of the plane of the planar patch antenna. By this means, the surface of the antenna can be reduced so as to conform better to certain design parameters.

BRIEF DESCRIPTION OF THE DRAWINGS

The various objects, advantages and novel features of the present disclosure will be more readily apprehended from the following Detailed Description when read in conjunction with the enclosed drawings, in which.

DETAILED DESCRIPTION

Figure 1:
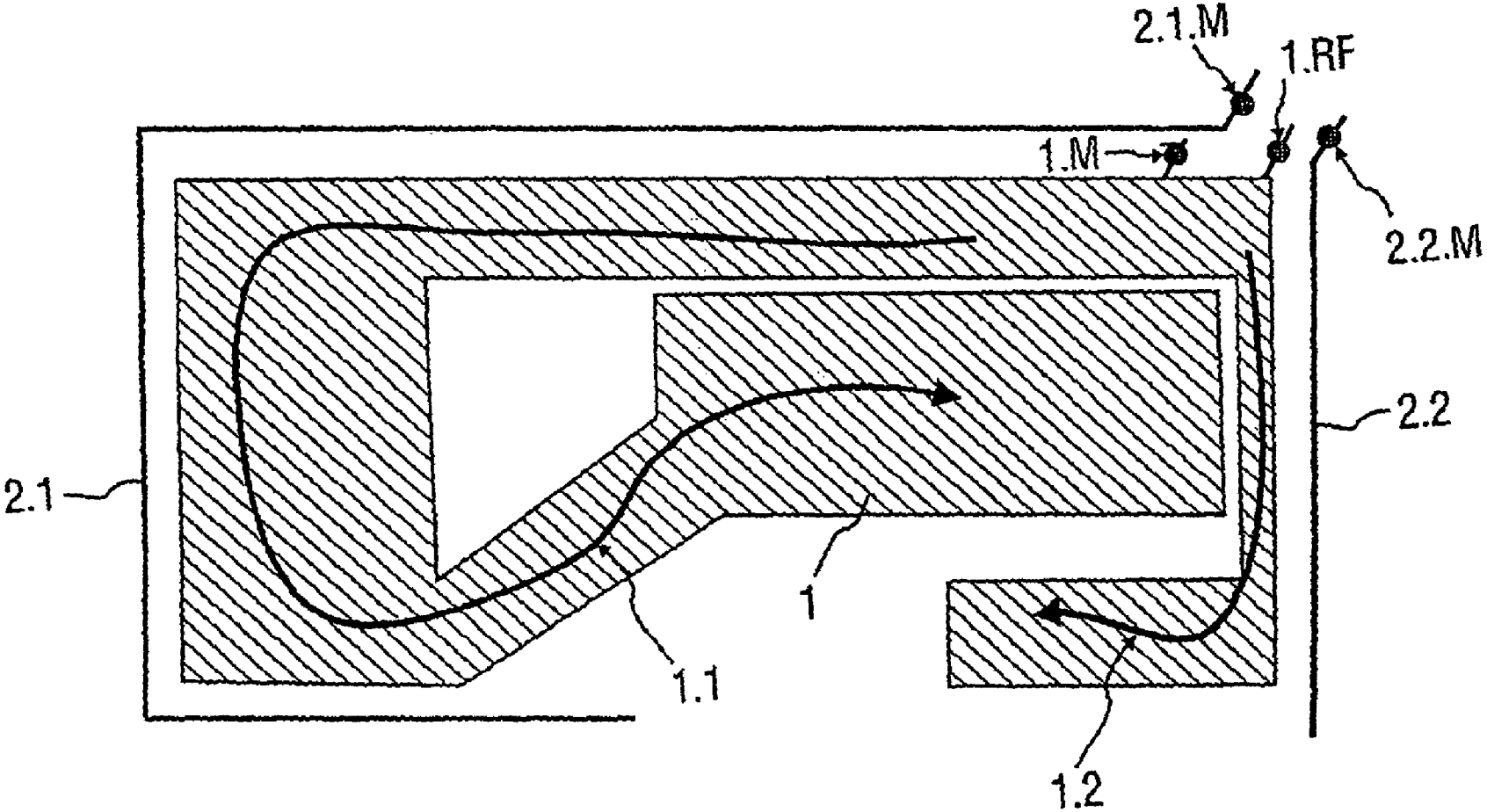
FIG. 1 illustrates a planar multiband antenna array comprising a planar patch antenna, two parasitic transmitters and comprising a total of four contact points under an exemplary embodiment.

FIG. 1 shows a planar multiband antenna array. The planar patch antenna labeled 1 has in this embodiment two resonances 1.1 and 1.2 which are illustrated as arrows. This planar patch antenna 1 has both a connection to ground 1.M and a high-frequency interface 1.RF.

Two parasitic transmitters 2.1 and 2.2 are arranged in the same plane of the planar patch antenna 1. The parasitic transmitters 2.1 and 2.2 are each provided with their own connection to ground 2.1.M and 2.2.M and thus have a galvanic and an electromagnetic coupling to the planar patch antenna 1. The first parasitic transmitter 2.1 extends almost over three adjacent sides of the planar patch antenna 1, while the second parasitic transmitter 2.2 extends only on one side. These different embodiments of the parasitic transmitters 2.1 and 2.2 make it possible for two further resonances to be set. The resonances of the parasitic transmitters are not shown in FIG. 1.

Figure 2:
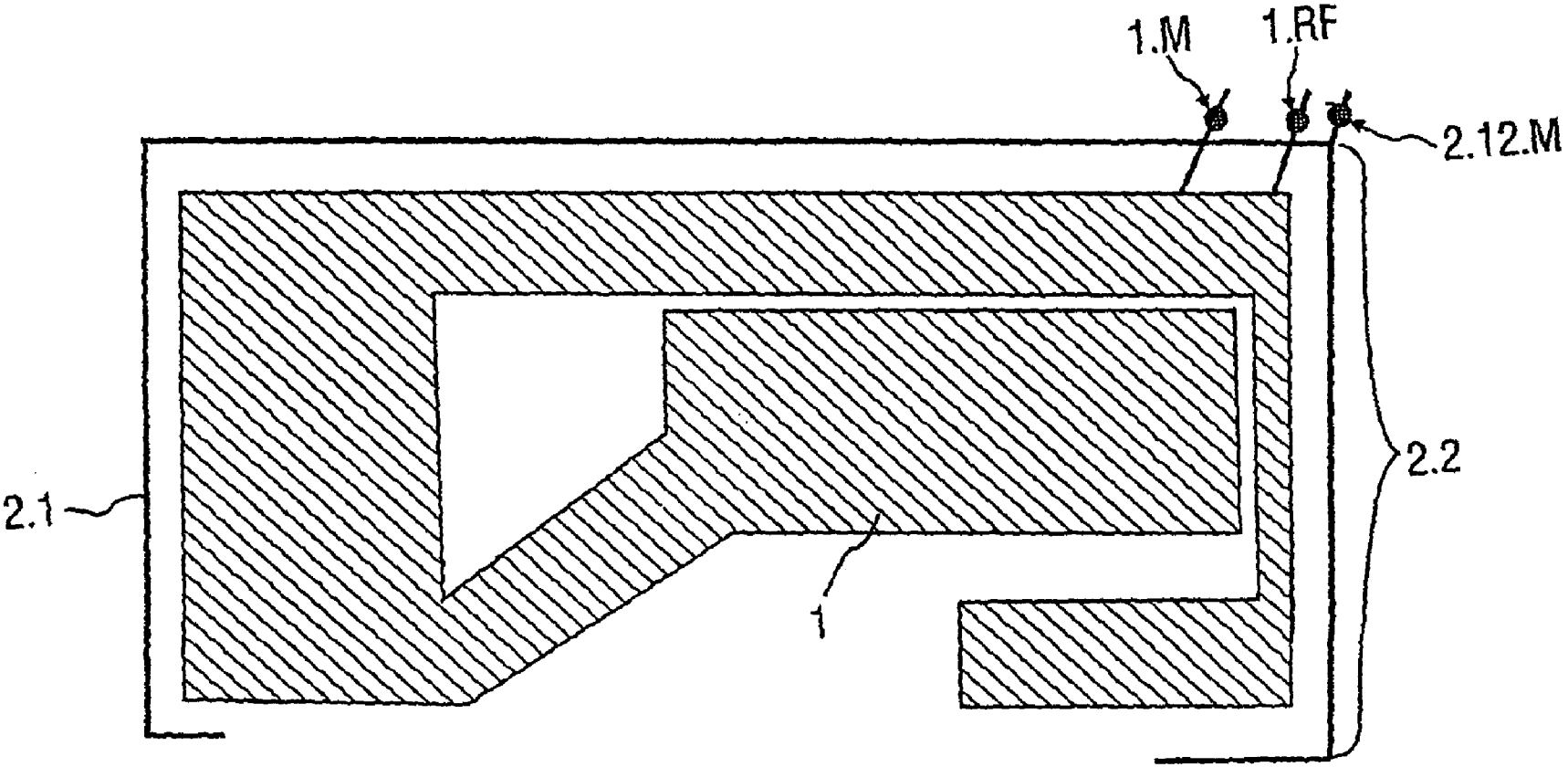
FIG. 2 illustrates a planar multiband antenna array comprising a planar patch antenna and two parasitic transmitters which both use the same connection to ground under another exemplary embodiment.

FIG. 2 illustrates a further embodiment of the multiband antenna array. The planar patch antenna 1 is constructed similarly to that in FIG. 1. In contrast to FIG. 1, the parasitic transmitters 2.1 and 2.2 here both use the same connection to ground 2.12.M and are thus galvanically and electromagnetically coupled to the planar patch antenna 1.

Figure 3:
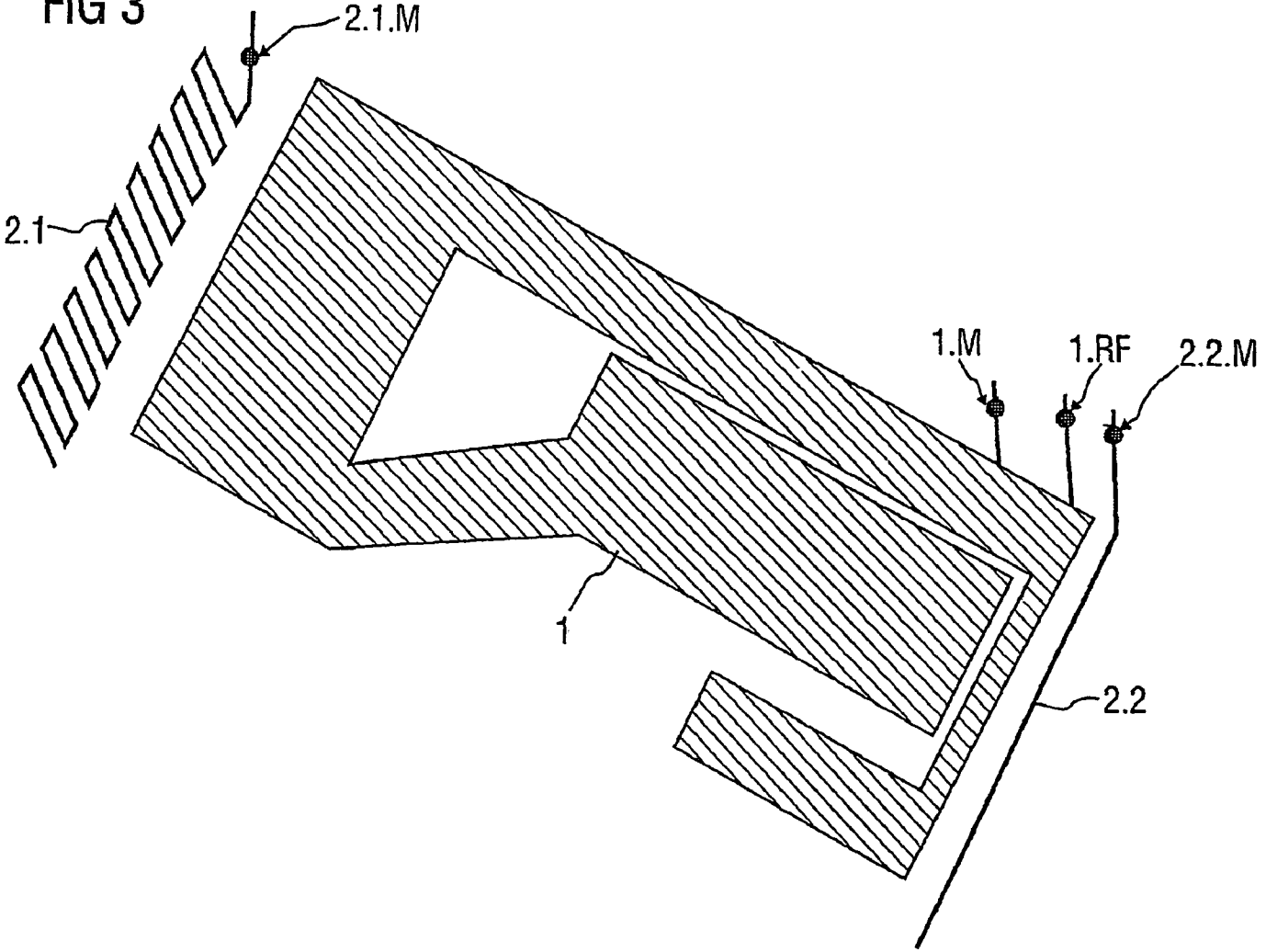
FIG. 3 illustrates a multiband antenna array comprising a planar patch antenna, a planar parasitic transmitter, a three-dimensionally extended parasitic transmitter and comprising a total of four contact points under yet another exemplary embodiment.

FIG. 3 illustrates another embodiment of the multiband antenna array. The planar patch antenna 1 has both a connection to ground 1.M and a high-frequency interface 1.RF. A parasitic transmitter 2.2 is arranged in the same plane as the planar patch antenna 1 on the right-hand side in FIG. 3. This parasitic transmitter 2.2 extends over one side of the planar patch antenna 1 and, through its connection to ground 2.2.M, has a galvanic and an electromagnetic coupling to the planar patch antenna 1. The first parasitic transmitter 2.1 arranged on the left-hand side in FIG. 3 also has its own connection to ground 2.1.M. This parasitic transmitter 2.1 is three-dimensionally extended and extends outside the plane of the planar patch antenna in the form of alternate meander-shaped turns.

Figure 4:
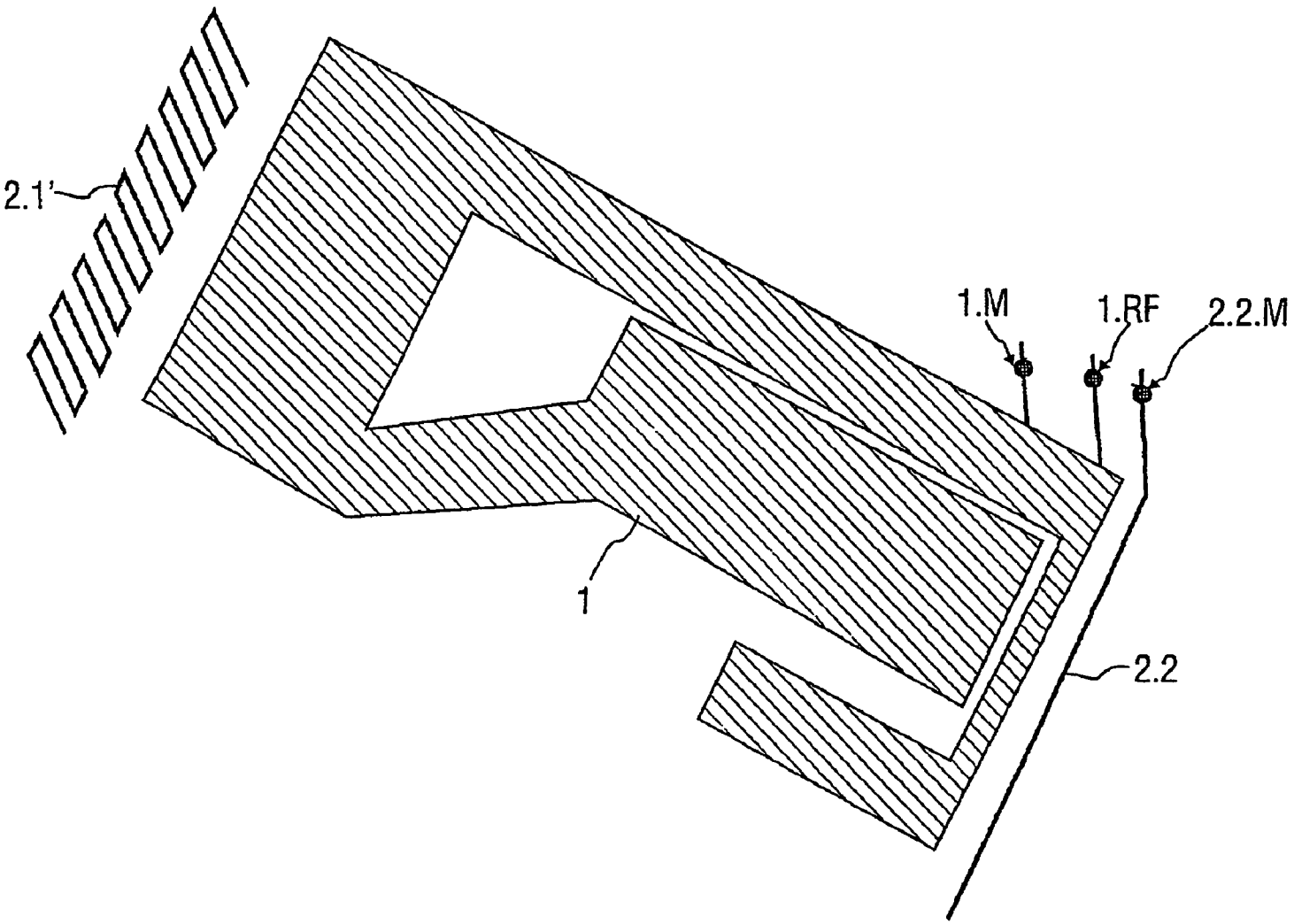
FIG. 4 illustrates a multiband antenna array as shown in FIG. 3, the three-dimensionally extended parasitic transmitter having no connection to ground.

FIG. 4 illustrates an alternate arrangement to the multiband antenna array from FIG. 3. In contrast to FIG. 3, this embodiment of the multiband antenna array is provided with only three contact points. The three-dimensionally extended parasitic transmitter 2.1' does not have its own connection to ground and thus has a purely radiative coupling to the planar patch antenna.

Overall, the invention thus provides a multiband antenna array for mobile radio equipment that can be manufactured particularly inexpensively and can cover as many frequency bands as possible, while requiring minimal space in the mobile radio device.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

LIST OF REFERENCE CHARACTERS

1 planar patch antenna
1.M connection to ground of the planar patch antenna
1.RF high-frequency interface of the planar patch antenna
1.1 first resonance of the planar patch antenna (symbolized by the arrow)
1.2 second resonance of the planar patch antenna (symbolized by the arrow)
2.1 first parasitic transmitter
2.1 first parasitic transmitter without a connection to ground
2.2 second parasitic transmitter
2.1.M connection to ground of the first parasitic transmitter
2.2.M connection to ground of the second parasitic transmitter
2.12.M shared connection to ground of the first and second parasitic transmitters

The invention claimed is:

1. A multiband antenna array for a mobile radio equipment, comprising:

a planar patch antenna defining a plane and having a first branch that resonates in a first frequency band and a second branch that resonates in a second frequency band and is further coupled to a ground connection and to a high-frequency interface, the planar patch antenna having a first side and a second side, the first side being adjacent to the second side; and a plurality of parasitic transmitters, wherein said plurality of parasitic transmitters are located (i) marginal to the planar patch antenna, (ii) outside of the planar patch antenna, and (iii) in the plane defined by the planar patch antenna, wherein:

(i) each of the plurality of parasitic transmitters are embodied so as to be free of said high-frequency interface;

(ii) said plurality of parasitic transmitters are arranged as line-shaped conductor structures; and (iii) at least one of said plurality of parasitic transmitters which forms a bend includes:

(a) a first three dimensional line-shaped portion that extends in a first dimension in the plane, the first three dimensional line-shaped portion running parallel to the first side; and (b) a second three dimensional line-shaped portion that extends in a second different dimension in the plane, the second three dimensional line-shaped portion running parallel to the second side, wherein conductor structures of the planar patch antenna are arranged as sheet-shaped conductor structures.

2. The multiband antenna array according to claim 1, wherein at least one parasitic transmitter is provided with a connection to ground.

3. The multiband antenna array according to claim 1, wherein the plurality of parasitic transmitters are provided with a shared connection to ground.

4. The multiband antenna array according to claim 1, wherein at least one parasitic transmitter is free of connections to ground.

5. The multiband antenna array according to claim 1, wherein the plurality of parasitic transmitters are arranged on opposite sides of the planar patch antenna.

6. The multiband antenna array according to claim 4, wherein the plurality of parasitic transmitters are located on adjacent sides of the planar patch antenna.

7. The multiband antenna array according to claim 1, wherein said one of said plurality of parasitic transmitters extends at least partially over three adjacent sides of the planar patch antenna.

8. The multiband antenna array according to claim 1, wherein said one of said plurality of parasitic transmitters extends at least partially over four sides of the planar patch antenna.

9. The multiband antenna array according to claim 1, wherein the planar patch antenna and said plurality of parasitic transmitters are arranged in a same plane.

10. The multiband antenna array according to claim 1, wherein at least one parasitic transmitter has a spatial extension, emerging perpendicularly out of the plane defined by the planar patch antenna.

* * * * *